US005731675A

United States Patent [19]

McCarthy

[11] Patent Number: 5,731,675

[45] Date of Patent: Mar. 24, 1998

[54] ADJUSTABLE MOTOR CONTROL CIRCUIT FOR POWER WINDOWS

[75] Inventor: Michael Charles McCarthy, Birmingham, Mich.

[73] Assignee: TRW Inc., Lyndhurst, Ohio

[21] Appl. No.: 763,073

[22] Filed: Dec. 10, 1996

[51] Int. Cl.[6] ..... E05F 15/16

[52] U.S. Cl. ..... 318/469; 318/286; 318/484; 388/907.5; 388/921

[58] Field of Search ..... 318/256, 264, 318/265, 266, 280, 283, 285, 286, 430, 445, 466, 468, 469, 484; 388/907.5, 921; 307/9.1, 10.1

[56] References Cited

U.S. PATENT DOCUMENTS

| | | | |
|---|---|---|---|
| 4,001,661 | 1/1977 | Terabayashi . | |
| 4,373,149 | 2/1983 | Coste . | |
| 4,394,605 | 7/1983 | Terazawa | 318/280 |
| 4,476,416 | 10/1984 | Licata et al. . | |
| 4,678,975 | 7/1987 | Vrabel et al. . | |
| 4,900,994 | 2/1990 | Mizuta | 318/283 |
| 4,931,714 | 6/1990 | Yamamoto | 318/663 |
| 5,128,597 | 7/1992 | Kokubu . | |
| 5,483,135 | 1/1996 | Parks | 318/469 |
| 5,559,375 | 9/1996 | Jo et al. | 318/293 X |
| 5,572,101 | 11/1996 | Rutkowski et al. | 318/470 |

*Primary Examiner*—Bentsu Ro

*Attorney, Agent, or Firm*—Tarolli, Sundheim, Covell, Tummino & Szabo

[57] ABSTRACT

An apparatus (10) and a method for controlling a power window drive motor (12). A first RC circuit (110, 106) is used to provide a first time limit and a second RC circuit (114, 106) is used to provide a second time limit. A switch (28) is actuatable to provide a signal having a time duration. A logic circuit (132) determines whether the time duration of the signal from the switch (28) exceeds the first time limit. The motor (12) is operated to move a window (14) through a predetermined range of movement responsive to the time duration of the signal from the switch (28) exceeding the first time limit. The logic circuit (132) determines whether the time duration of operation of the motor (12) exceeds the second time limit. The motor (12) is stopped responsive to the time duration of operation of the motor exceeding the second time limit. The second time limit is set independent of the first time limit using two exchangeable resistors (110, 114).

12 Claims, 3 Drawing Sheets

ADJUSTABLE MOTOR CONTROL CIRCUIT FOR POWER WINDOWS

TECHNICAL FIELD

The present invention is directed to a motor-driven or "power" window system in a vehicle, and is specifically directed to a "one-touch control" window system.

BACKGROUND OF THE INVENTION

Control systems for vehicle power windows are well known in the art. A typical control system includes two switching mechanisms. Actuation of one switching mechanism causes a motor to move the window up and actuation of the other switching mechanism causes the motor to move the window down.

It is also known to have a one-touch control mode of operation provided by the control system. To actuate the one-touch control mode, an occupant of the vehicle actuates one of the switching mechanisms for a predetermined time duration. The occupant then releases the switching mechanism and the motor continues to move the window to the end of the travel range. The predetermined time duration of switch actuation is substantially less than the operation time of the motor. A one-touch control mode for lowering the window is specifically know as an "auto-down mode".

At the end of the travel range of the window in the auto-down mode, the motor stalls. In response to the stall condition of the motor, operation of the motor is stopped. It is also known to provide a time limit on the operation of the motor as a fail-safe. Thus, if the stall condition of the motor does not occur within the time limit, or the stall condition is not detected, the motor operation is stopped at the end of the time limit.

SUMMARY OF THE INVENTION

The present invention provides to an apparatus and a method for controlling a power window drive motor to move a window.

The apparatus includes switch means actuatable for providing a signal having a time duration. The apparatus includes means for selectively setting a first time limit. Means are provided for determining whether the time duration of the signal from the switch means exceeds the first time limit. Means operate the motor to move the window through a predetermined range of movement responsive to the time duration of the signal from the switch means exceeding the first time limit. The apparatus further includes means for selectively setting a second time limit. Means are provided for determining whether the time duration of operation of the motor exceeds the second time limit. Means stop the motor responsive to the time duration of operation of the motor exceeding the second time limit.

In accordance with one preferred embodiment, the means for selectively setting the second time limit sets the second time limit independent of the first time limit. In accordance with another preferred embodiment, the means for selectively setting the first time limit includes a first RC circuit which has an exchangeable resistor. The means for selectively setting the second time limit includes a second RC circuit having an exchangeable resistor.

The method includes selectively setting a first time limit and selectively setting a second time limit. A switch means is actuated to provide a signal which has a time duration. It is determined whether the time duration of the signal from the switch means exceeds the first time limit. A motor is operated to move the window through a predetermined range of movement responsive to the time duration of the signal from the switch means exceeding the first time limit. It is determined whether a time duration of operation of the motor exceeds the second time limit. The motor is stopped responsive to the time duration of operation of the motor exceeding the second time limit.

In accordance with one preferred embodiment of the method, the step of selectively setting the second time limit is such that the second time limit is independent of the first time limit. In accordance with another preferred embodiment, the step of selectively setting a first time limit includes selecting a first exchangeable resistor and connecting the first resistor into a first RC circuit. The step of selectively setting a second time limit includes selecting a second exchangeable resistor and connecting the second resistor into a second RC circuit.

BRIEF DESCRIPTION OF THE DRAWINGS

The foregoing and other features and advantages of the present invention will become apparent to one skilled in the art to which the present invention relates upon consideration of the following description of the invention with reference to the accompanying drawings, wherein.

DESCRIPTION OF PREFERRED EMBODIMENTS

Figure 1:
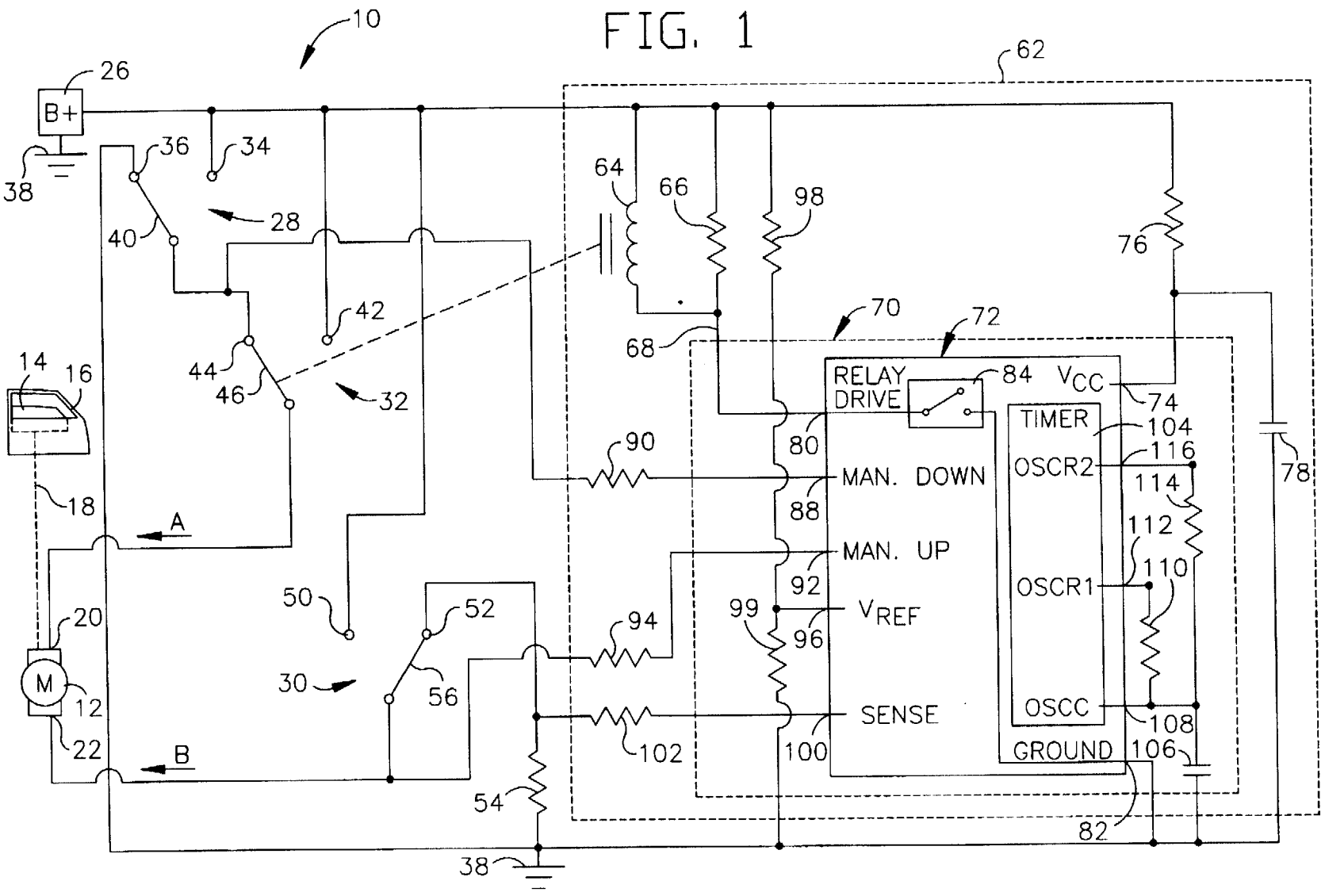
FIG. 1 is a schematic representation of a power window control circuit in accordance with the present invention.

A power window control circuit 10 according to the present invention is schematically shown in FIG. 1. The control circuit 10 controls operation of a drive motor 12 to raise or lower a window 14 located within a door 16 of a vehicle (not shown). It is to be understood that the invention may be utilized in a non-vehicle environment.

A mechanical connection 18 exists between the window 14 and the motor 12. The motor 12 is a bi-directional motor with first and second terminals 20, 22, respectively. The motor 12 is operated in a first direction to lower the window 14 when current (arrowhead A, FIG. 1) from a power supply 26 flows through the motor in a first direction. The motor 12 is operated in a second direction to raise the window 14 when current (arrowhead B, FIG. 1) flows through the motor in a second direction.

The control circuit 10 includes a power supply switching portion through which the currents A, B flow. The power supply switching portion of the control circuit 10 includes a manually actuatable down switch 28, a manually actuatable up switch 30, and an electrically actuatable relay down switch 32 which are used to control the currents A, B. The down switch 28 has a positive terminal 34 connected to the positive terminal of the power supply 26 and a ground terminal 36 connected to electrical ground 38.

A pole 40 of the down switch 28 can be toggled between the positive and ground terminals 34, 36, respectively. The pole 40 of the down switch 28 is biased by a mechanical means (not shown, e.g., a spring) to its unactuated position (shown in FIG. 1). In the unactuated position, the pole 40 of the down switch 28 engages the ground terminal 36. Upon manual actuation by a vehicle occupant, the pole 40 of the down switch 28 is moved to engage the positive terminal 34. Although, the down switch 28 is shown and described as a simple, two position switch, it is to be understood that a different device which provides a suitable switching function could be used.

The relay down switch 32 has a positive terminal 42 connected to the positive terminal of the power supply 26 and a through terminal 44 connected to the terminal of pole 40 of the down switch 28. A terminal of a pole 46 of the relay down switch 32 is connected to the first motor terminal 20. The pole 46 can be switched between the through terminal 44 and the positive terminal 42 of the relay down switch. The pole 46 of the relay down switch 32 is biased by a mechanical means (not shown, e.g., a spring) to an unactuated position (shown in FIG. 1). In the unactuated position, the pole 46 engages the through terminal 44.

The up switch 30 has a positive terminal 50 connected to the positive terminal of the power supply 26 and a ground terminal 52 connected through a resistor 54 to electrical ground 38. A terminal of a pole 56 of the up switch 30 is connected to the second terminal 22 of the motor 12. The pole 56 can be toggled between the positive terminal 50 and the ground terminal 52. The internal structure of the up switch 30 is similar to that of the down switch 28. The pole 56 of the up switch 30 is biased by a mechanical means (not shown, e.g., a spring) to an unactuated position (shown in FIG. 1). In the unactuated position, the pole 56 of the up switch 30 engages the ground terminal 52. Upon manual actuation of the up switch 30, the pole 56 is moved to engage the positive terminal 50.

When switches 28, 30, and 32 are in their biased position shown in FIG. 1, each of the motor terminals 20, 22 is connected to electrical ground and the motor 12 is, therefore, not energized. The window 14 is lowered by manual actuation of the down switch 28 (i.e., movement of the pole 40 from the ground terminal 36 to the positive terminal 34). An electrical current path is provided from the positive terminal of the source 26, through the positive terminal 34, the pole 40 of the down switch 28, the through terminal 44 of the relay down switch 32, and the pole 46 of the relay down switch 32 to the first motor terminal 20 (arrowhead A). The motor terminal 22 of motor 12 remains connected to electrical ground through the pole 56, the ground terminal 52, and through the resistor 54. This provides a completed circuit path so current flows in the direction A and energizes the motor to drive the window 14 down.

The window 14 is raised by manual actuation of the up switch 30 (i.e., movement of the pole 56 to engage the positive terminal 50). An electrical current path is provided from the positive terminal of the source 26, through the positive terminal 50 and pole 56 of the up switch 30 to the second terminal 22 (arrowhead B). The motor terminal 20 remains connected to electrical ground through the pole 46, terminal 44 of the relay down switch 32, through the pole 40 and ground terminal 36 of the down switch 28.

The down switch 28 and the up switch 30 are preferably connected or inter-linked such that both switches can not simultaneously be actuated. Preferably, switches 28, 30 are embodied in a rocker switch that is center biased. Rocking motion in one direction actuates one switch and motion in the other direction actuates the other switch.

The power window control circuit 10 further includes an auto-down circuit 62 which controls actuation of the relay down switch 32 so as to continuously energize the motor 12 to drive the window 14 down. The auto-down circuit 62 includes a relay control coil 64 connected in parallel with a resistor 66 between the power supply 26 and a line 68. When electrical current flows through the relay control coil 64, the relay down switch 32 is actuated so that the pole 46 of the relay down switch is moved from the through terminal 44 to the positive terminal 42. When the relay 32 is in this actuation position, electrical current flows from the power supply 26 through the positive terminal 42 and the pole 46 of the relay down switch 32 to the first terminal 20 of the motor 12 (arrowhead A). Terminal 22 remains connected to ground through resistor 54. With these connections, the motor 12 operates in the first direction and the window 14 is lowered. The operation of the motor 12 via actuation of the relay down switch 32 is referred to as an "auto-down" mode of operation.

The line 68 from the relay control coil 64 and resistor 66 is connected to an auto-down control circuit 70. The auto-down control circuit 70 controls the flow of current through the relay control coil 64 and, thus, controls actuation of the relay down switch 32. The auto-down control circuit 70 is responsive to: (i) manual actuation of the down and up switches 28, 30, (ii) a time duration of the actuation of the down switch 28, (iii) a stall condition of the motor 12, and (iv) a time duration of operation of the motor 12. Specifically, the relay control coil 64 is energized when the down switch 28 is actuated for an amount of time greater than a first predetermined time limit. The relay control coil 64 is deenergized upon: (i) a subsequent actuation of either the down switch 28 or the up switch 30 while the relay down switch 32 is actuated, (ii) a stall condition of the motor 12 is sensed, or (iii) motor energization time greater than a second predetermined time limit.

The auto-down control circuit 70 includes a command element 72 which has circuitry for processing, timing, and controlling functions. Preferably, the command element 72 is either a microcomputer or an application specific integrated circuit ("ASIC") designed to perform specific functions in accordance with the present invention. The command element 72 has a power supply terminal $V_{cc}$ 74 connected to the power supply 26 through a resistor 76 and also connected to ground 38 through a capacitor 78. The command element 72 is powered by electrical energy received at the power supply terminal $V_{cc}$ 74.

The command element 72 has a relay drive terminal 80 connected to the line 68 from the relay control coil 64 and resistor 66. A ground terminal 82 of the command element 72 is connected to ground 38. A switching means 84 within the command element 72 functions to controllably connect the relay drive terminal 80 with the ground terminal 82. In a pass state of the switching means 84, the relay drive terminal 80 is connected to ground 38 through the switching means and current flows through the line 68 from the relay control coil 64 which switches pole 46 to terminal 42. In a block state of the switching means 84, the current flow is blocked and pole 46 is at terminal 44. Accordingly, when the switching means 84 changes from the block state to the pass state, the relay control coil 64 is energized and the relay down switch 32 is actuated. The switching means 84 is normally held in the block state by processing logic within control element 72.

The command element 72 is connected to receive signals from various locations of the power supply portion of the control circuit 10 (i.e., the portion which powers the motor 12 by delivering current A or B). A manual down terminal 88 of the command element 72 is connected to the pole 40 of the down switch 28 through a resistor 90. A manual up terminal 92 of the command element 72 is connected to the pole 56 of the up switch 30 through a resistor 94. When the down switch 28 is actuated (i.e., the pole 40 is in contact with the positive terminal 34), a HIGH signal (i.e., the supply voltage) is provided to the manual down terminal 88 of the command element 72. Similarly, when the up switch 30 is actuated, a HIGH signal is provided to the manual up terminal 92.

A voltage reference terminal $V_{ref}$ 96 of the command element 72 is connected to the power supply 26 through a resistor 98 and to electrical ground 38 through resistor 99. The resistors 98, 99 are selected such that a predetermined voltage is present at the voltage reference terminal $V_{ref}$ 96. A sense terminal 100 of the command element 72 is connected to the ground terminal 52 of the up switch 30 through a resistor 102. A voltage is present at the sense terminal 100 which is related to a voltage potential across the resistor 54. At the end of the downward range of travel of the window 14, the window abuts a stop (not shown) and the motor 12, unable to keep operating, stalls. As the motor 12 stalls at the end of a downward range of travel of the window 14, the voltage drop across the resistor 54 increases. Therefore, the voltage across resistor 54 is indicative of whether the motor 12 is in a stall condition.

The command element 72 further includes a timer 104 which counts out the first and second predetermined time limits. To do this, the timer 104 counts a first predetermined number of pulses to establish the first time limit and counts a second predetermined number of pulses to establish the second time limit. In one preferred embodiment, the first and second predetermined numbers are 90 and 800, respectively. The time duration from initiation (i.e., time equal zero) to the first time limit is a first period of time, and the time duration from initiation to the second time limit is the first period of time plus a second period of time. The actual time durations of the first and second periods of time are dependent upon the clock frequency of the pulses being counted. In the one preferred embodiment, the first time limit (i.e., the duration of the first period of time) is in the range of 0.8–1.0 seconds and the second time limit (i.e., the duration of the first period of time plus the second period of time) is in the range of 7.0–9.0 seconds.

Actuation of the down switch 28 by the vehicle occupant in excess of the first time limit is a request by the vehicle occupant to have automatic downward movement of the window 14 (i.e., auto-down mode). The second time limit is used in a fail-safe arrangement to stop operation of the motor 12 during the auto-down mode if the motor is operated in excess of the second time limit. The motor 12 operates in excess of the second time limit when an error or fault condition exists. For example, when the window 14 normally reaches the end of its range of travel and engages a stop the motor 12 should stall. However, if the mechanical connection 18 between the motor 12 and the window 14 is disconnected, then the motor would continue to operate because the motor would not stall. The second time limit is used to prevent such long continuous operation of the motor 12.

The timer 104 utilizes an externally connected capacitor 106 of capacitance value $C_1$ and which is connected between an oscillator circuit (OSCC) terminal 108 of the command element 72 and ground 38. The capacitor 106 is alternately charged and discharged by an oscillator circuit internal to the timer 104. The clock frequency of the oscillator is based upon this charge/discharge cycle. Thus, the clock frequency for the timer 104 can be varied by varying the length of time for the capacitor charge/discharge cycle. This is accomplished by selection of a charging resistor.

A first charging resistor 110, having a resistive value of $R_1$, is connected between an OSCR1 terminal 112 of the command element 72 and the capacitor 106, at the connection of the capacitor to the OSCC terminal 108. The first resistor 110 and the capacitor 106 form a first RC circuit which extends between the OSCR1 terminal and ground 38. The first RC circuit has a time constant of $R_1C_1$. A second resistor 114, having a resistive value of $R_2$, is connected between an OSCR2 terminal 116 of the command element 72 and the capacitor 106, at the connection of the capacitor to the OSCC terminal 108. The second resistor 114 and the capacitor 106 form a second RC circuit which extends between the OSCR2 terminal and ground 38. The second RC circuit has a time constant of $R_2C_1$.

Oscillator circuits that have a clock frequency dependent upon an RC network are well known in the art. Any of these oscillator types can be used in the timer 104. Since such oscillators are well known in the art, no specific oscillator structure is described. It is contemplated, that such an oscillator could use the well known 555 timer as an oscillator basis.

During the first period of time (i.e., prior to the first time limit), the timer 104 "enables" the OSCR1 terminal 112 by providing a predetermined voltage to the OSCR1 terminal. The timer 104 "disables" the OSCR2 terminal 116 by providing a high impedance at the OSCR2 terminal and by not providing a voltage to the OSCR2 terminal. Electric current flows through the first resistor 110 toward the capacitor 106. The timer 104 also alternately disables and enables the OSCC terminal 108. Current flows through the OSCC terminal 108 when enabled. Current flow is blocked through the OSCC terminal 108 when the OSCC terminal is disabled.

The capacitor 106 charges when the OSCC terminal 108 is disabled and the capacitor discharges when the OSCC terminal is enabled. The rate that the capacitor 106 charges is proportional to the amount of current flow through the first resistor 110. Thus, the charge rate of the capacitor 106 is proportional to the resistor value $R_1$ of the first resistor 110. A first clock frequency is provided by the charge/discharge cycle of the capacitor 106 during the first period of time.

After the first time limit (i.e., the second period of time), the timer 104 enables the OSCR2 terminal 116 with the predetermined voltage and disables the OSCR1 terminal 112. Electrical current flows through the second resistor 114 to the capacitor 106. The OSCC terminal 108 is again alternately enabled and disabled. During the second period of time, the charge rate of the capacitor 106 is proportional to the resistor value of the second resistor 114 and a second clock frequency is provided.

If the first and second resistors 110, 114 have different resistor values, the first and second clock frequencies are different. Thus, the length of each period of time is not only dependent upon the number of pulses needed to be counted for that time period, but is also dependent upon the frequency of the pulses controlled by the RC time constant.

Further, the first and second resistors 110, 114 are separately accessible. Each resistor 110, 114 can be readily exchanged (denoted in the figures by connection dots at each end) with a new resistor having a new resistive value (e.g. $R_1'$, $R_2'$). Thus, each clock frequency can be adjusted independent of the other clock frequency. An advantage of the present invention is that the control circuit 10 can be utilized in different vehicles having different parameters (e.g., window size, window travel distance, motor speed, etc.) by merely exchanging one or both of the resistors 110, 114.

Figure 2:
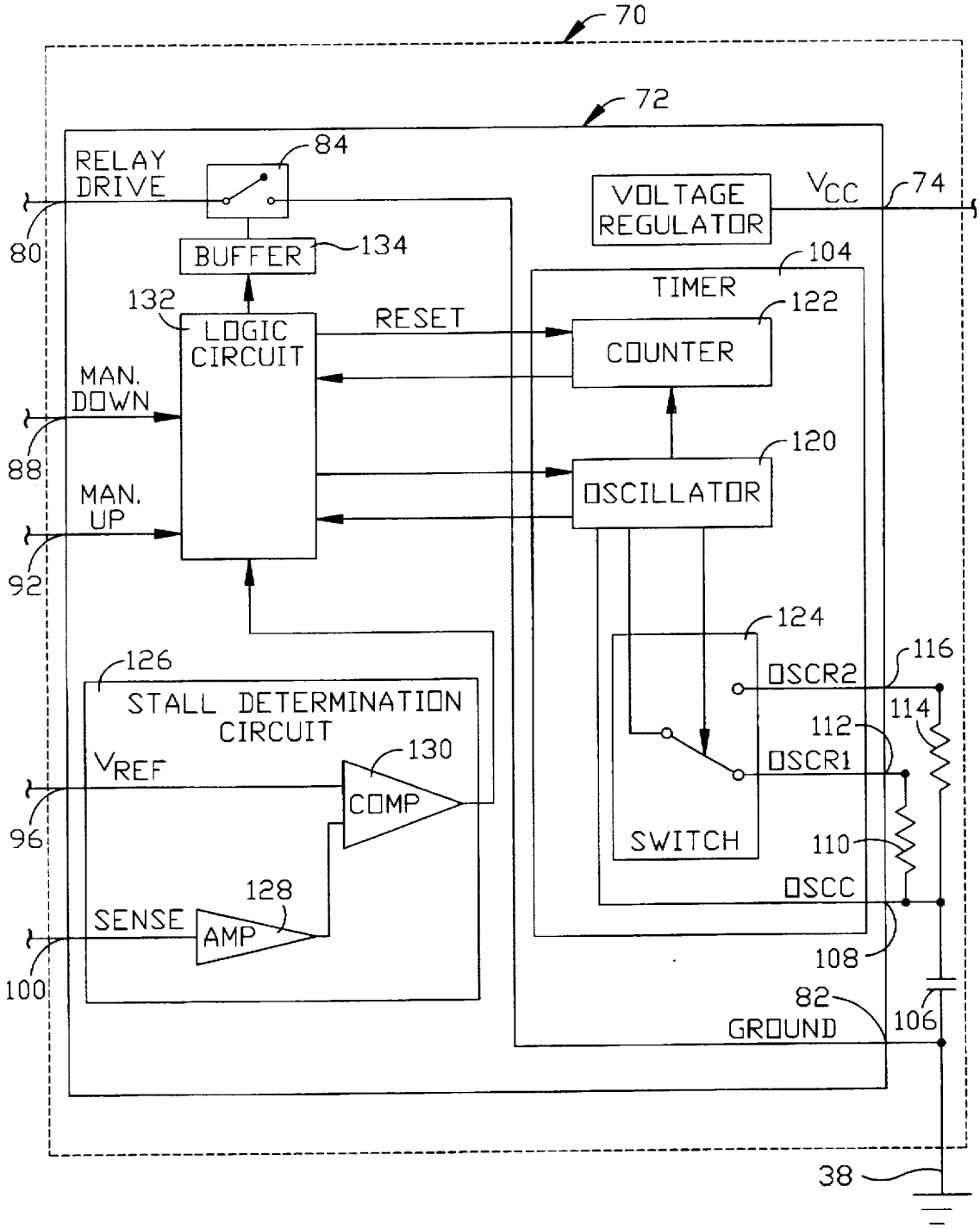
FIG. 2 is a schematic representation of an auto-down circuit portion of the control circuit shown in FIG. 1.

An example of the auto-down control circuit 70 in accordance with the present invention is shown in FIG. 2. The timer 104 includes an oscillator 120, a counter 122, and a switch 124. The oscillator 120 controls the switch 124 to connect (enable) either the OSCR1 terminal 112 to the oscillator 120 or the OSCR2 terminal 116 to the oscillator. The oscillator 120 uses either OSCR1 (resistor 110 and capacitor 106) or OSCR2 (resistor 104 and capacitor 106) as part of the oscillator circuit 120. The oscillator 120 is also connected to the OSCC terminal 108.

The voltage at the OSCC terminal 108, i.e., the voltage across the capacitor 106, is monitored within the oscillator 120 during the enable and disable states of the OSCC terminal. When the voltage at the OSCC terminal 108 reaches a predetermined upper threshold value, the oscillator 120 discharges the capacitor 106, i.e., current flows through the OSCC terminal. When voltage at the OSCC terminal 108 drops below a predetermined lower threshold value, the oscillator 120 permits the capacitor 106 to be recharged. Specifically, current flow through the OSCC terminal 108 is blocked and current flowing from the oscillator 120 through the switch 124 and through either the first or second resistor 110, 114 (dependent upon which of the OSCR1 and OSCR2 terminals is selected) again begins to charge the capacitor. When the voltage at the OSCC terminal again reaches the predetermined upper threshold value, the cycle repeats.

The period for cycle time of the charging and discharging of the capacitor 106 is dependent upon the value of the resistor (either 110 or 114) through which the charging current flows (i.e., dependent upon the RC time constant). Since the same capacitor is used in both circuits, the resistor value of the RC is the variable factor. Specifically, when the OSCR1 terminal 112 is selected, the cycle time is dependent upon the value of the first resistor 110 because the first resistor value limits the amount of current flow. Likewise, when the OSCR2 terminal 116 is selected, the cycle time is dependent upon the resistor value of the second resistor 114. It should be appreciated that the cycle time determines the frequency of the oscillator 120. Therefore, the oscillator 120 outputs one of two selected clock frequencies controlled by the selection of either the connection to the OSCR1 or OSCR2 terminal. For each cycle, the oscillator 120 provides a count signal to the counter 122 of the timer 104 having the associated clock frequency. The counter 122 maintains a running numeric count of the number of count signals received from the oscillator 120. It will be appreciated that a shorter cycle time, i.e., higher clock frequency, results in the numeric count incrementing faster.

A stall determination circuit 126 within the command element 72 includes an amplifier 128 and a comparator 130. The amplifier 128 amplifies the voltage signal at the sense terminal 100 and provides the amplified voltage signal to one input of the comparator 130. The other input of the comparator 130 is connected to the voltage reference terminal $V_{ref}$ 96. When the motor 12 (FIG. 1) stalls at the end of the downward range of travel of the window 14, the amplified voltage signal from terminal 100 exceeds the voltage at the voltage reference terminal $V_{ref}$ 96 (FIG. 2) and the comparator 130 outputs a HIGH signal.

A logic circuit 132 of the command element 72 is connected to receive signals from the manual down terminal 88, the manual up terminal 92, the timer 104 and the stall determination circuit 126. These signals are processed within the logic circuit 132. The logic circuit 132 determines: (i) if the down switch 28 is actuated, (ii) if the up switch 30 is actuated, and (iii) if the motor 12 has stalled. Further, the logic circuit 132 determines whether the duration of the actuation of the down switch 28 exceeds the first time limit and whether the duration of the motor operation exceeded the second time limit.

The logic circuit 132 is connected to a buffer 134 which is, in turn, connected to the switching means 84. The logic circuit 132, through the buffer 134, controls the state (i.e., pass or block) of the switching means 84. Accordingly, the logic circuit 132 controls current flow through the relay control coil 64 and, in turn, control the relay switch 32.

Figure 3:
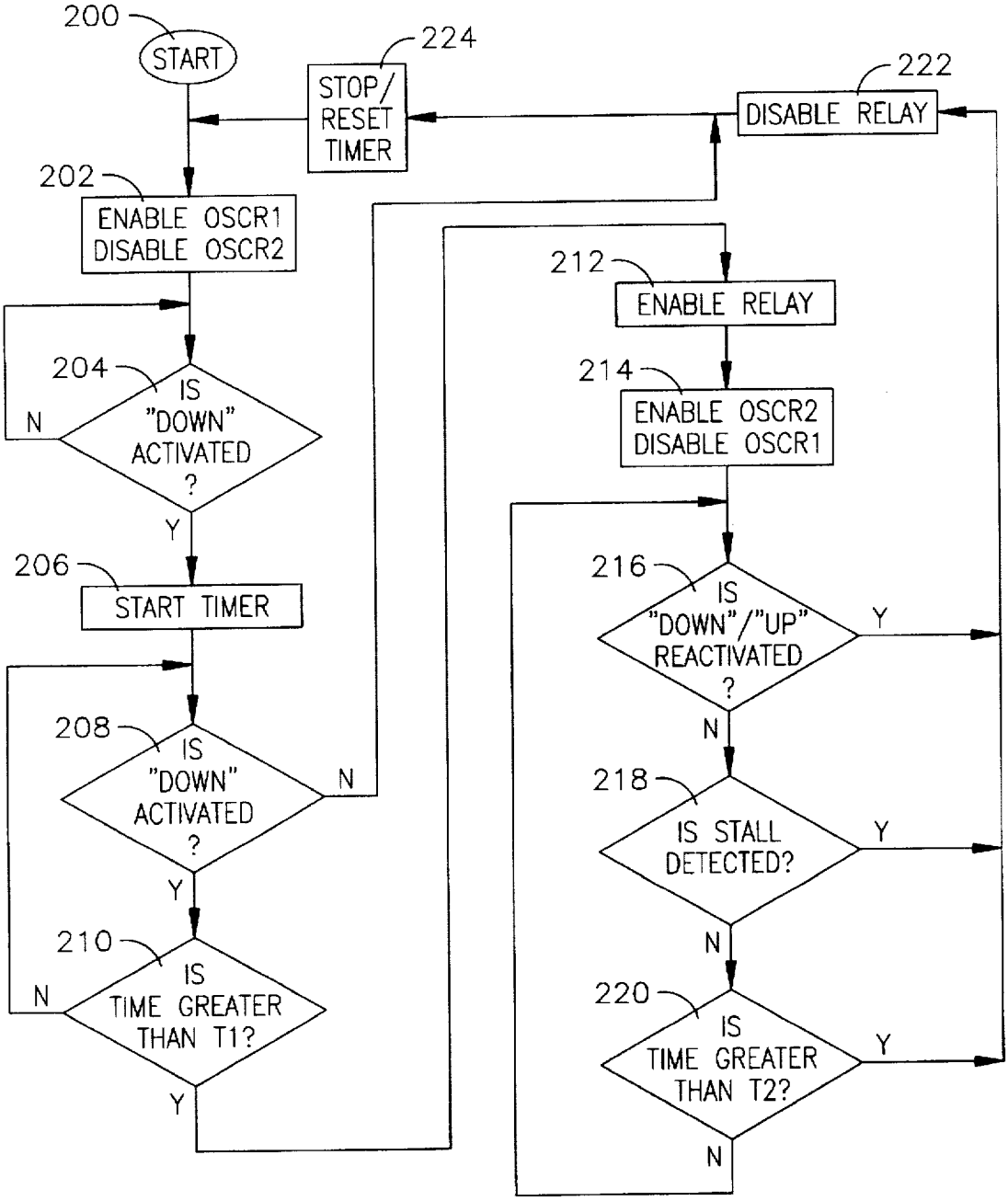
FIG. 3 is a flow chart showing a portion of a control process performed within a logic circuit of the auto-down circuit shown in FIG. 2.

Upon initiation of the operation of the control circuit 10 (e.g., a vehicle ignition switch, not shown, is closed), the motor 12 is ready to be operated, the switches 28, 30, and 32 are unactuated and the logic circuit 132 begins a process. The process performed by the logic circuit 132 determines whether the auto-down mode of operation should be initiated and, after the auto-down mode of operation is initiated, determines whether to cease the auto-down mode of operation. An example of the process performed within the logic circuit 132, in accordance with the present invention, is shown in FIG. 3.

The process is initiated at step 200 where initial states are set. The process proceeds to step 202 where the OSCR1 terminal 112 is enabled (connected to oscillator 120) and the OSCR2 terminal 116 is disabled (disconnected from the oscillator). The process proceeds to step 204 where it is determined whether the down switch 28 is actuated (i.e., whether a HIGH signal is preset at the manual down terminal 88). If the determination at step 204 is negative, the process loops back upon itself at step 204.

If the window position is satisfactory to the vehicle occupant, the vehicle occupant does not actuate either the down switch 28 or the up switch 30 (FIG. 1). The signals at the manual down and manual up terminals 88, 92 of the command element 72 remain LOW. Also, the output signal from the comparator 130 (FIG. 2) of the stall determination signal is LOW. The switching means 84 is in a block state and the relay control coil 64 is not energized. The window 14 remains stationary. The process (FIG. 3) of the logic circuit 132 continuously repeats step 204 until the down switch 28 is activated.

When the vehicle occupant desires the window 14 (FIG. 1) to be raised, the vehicle occupant actuates the up switch 30 to move the pole 56 to the positive terminal 50. The pole 40 of the down switch 28 remains in engagement with the ground terminal 36 and the pole 46 of the relay down switch 32 remains in engagement with the through terminal 44. The motor 12 is operated and the window 14 is raised. A HIGH signal is provided to the manual up terminal 92 of the command element 72 and a LOW signal is provided to the manual down terminal 88. The logic circuit 132 maintains the switching means 84 in the block state to maintain the relay drive terminal 80 in a disabled condition such that current does not flow through the relay control coil 64. After the window 14 is raised to a desired height, the up switch 30 is released by the operator. During the entire operation of raising the window 14, the process (FIG. 3) in the logic circuit 132 (FIG. 2) continuously repeats step 204 (i.e., the process awaits to be interrupted from repeating step 204).

When the vehicle occupant desires the window 14 (FIG. 1) to be lowered, the vehicle occupant actuates the down switch 28 to move the pole 40 to the positive terminal 34. The pole 56 of the up switch 30 remains in engagement with the ground terminal 52. Also, at least initially, the pole 46 of the relay down switch 32 remains engaged with the through terminal 44. The motor 12 is operated to lower the window 14.

When the pole 40 of the down switch 28 engages the positive terminal 34, a HIGH signal is provided to the manual down terminal 88 of the command element 72. The determination at step 204 (FIG. 3) is affirmative and the process proceeds to step 206. At step 206, the logic circuit 132 provides an initiate signal to the oscillator 120 and a reset signal to the counter 122. The timer 104 begins the timing routine to time the duration of the actuation of the down switch 28 and the duration of operation of the motor 12. The OSCC terminal 108 periodically discharges the capacitor 106. The repeating cycle of charging and discharging the capacitor 106 occurs. Each cycle is counted by the counter 122.

The process proceeds to step 208 in which it is determined whether the down switch 28 is still actuated (i.e., HIGH signal at the manual down terminal 88). If the determination at step 208 is affirmative, the process proceeds to step 210. At step 210, it is determined whether the first time limit is exceeded. In the embodiment shown in FIG. 2, this is accomplished within the logic circuit 132 by determining whether the running count provided by the counter exceeds the first predetermined number (e.g., 90) stored within the logic circuit. It is to be appreciated that the actual time length to the first time limit is dependent upon the time constant of the first RC circuit. Thus, the actual time is dependent upon the resistive value of the first resistor 110. If the determination at step 210 is negative, the process returns to step 208 to again determine whether the down switch 28 is still actuated.

If the operator maintains the down switch 28 in its actuated position for a duration exceeding the first time limit, the determination at step 210 will be affirmative. Upon the affirmative determination at step 210, the process proceeds to step 212. At step 212, the logic circuit 132 provides a signal to cause the switching means 84 to change to the pass state. The relay drive terminal 80 (FIG. 1) is enabled and current flows through the relay control coil 64. The pole 46 of the relay down switch 32 is moved to engage the positive terminal 42. The motor 12 is thus energized by current flowing from the power supply 26 through the positive terminal 42 and pole 46 of the relay down switch 32.

The process (FIG. 3) proceeds to step 214 where the logic circuit 132 provides a signal to the oscillator 120 and the oscillator toggles the switch 124. The OSCR2 terminal 116 is enabled (connected to the oscillator) and the OSCR1 terminal 112 is disabled (disconnected from the oscillator). The timer 104 now uses the second RC circuit (i.e., the second resistor 114 and the capacitor 106). The repeating cycle of charging and discharging the capacitor 106 continues, now at the second frequency, with each cycle being counted. The running count in the counter 122 continues to increase. However, the speed, i.e., frequency, at which the count increases is now dependent upon the time constant of the second RC circuit.

As the window 14 is being lowered, the process repeatedly loops through steps 216–220. At step 216, it is determined whether either the down switch 28 has been released and re-actuated, or whether the up switch 30 has been actuated subsequent to initiation of the auto-down mode of operation. Upon a negative determination at step 216, the process proceeds to step 218. At step 218, it is determined whether the motor 12 has stalled, i.e., the window 14 is at the furthest extent of its downward travel. If the determination at step 218, is negative (i.e., a stall has not occurred), then the process proceeds to step 220. At step 220, it is determined whether the second time limit has been exceeded.

In the embodiment shown in FIG. 2, this is accomplished within the logic circuit 132 by determining whether the running count provided by the counter 122 exceeds a second predetermined number (e.g., 800). It is to be appreciated that the actual time length of the second time period is dependent upon the time constant of the second RC circuit. Thus, the actual time length to the second time limit is dependant upon the resistance value of the second resistor 114. If the determination at step 220 (FIG. 3) is negative (i.e., the second time limit has not yet been exceeded), the process loops back to step 216.

Upon an affirmative determination in either step 216, 218 or 220, the process proceeds to step 222 in which the state of the switching means 84 is changed to the block state to disable the relay drive terminal 80. The relay control coil 64 is de-energized and the pole 46 of the relay down switch 32 moves back to engage the through terminal 44. The process proceeds to step 224 where the timer 104 is stopped and reset. The process proceeds to step 202 and then to step 204 to again await actuation of the down switch 28.

If, during the first period of time (i.e., prior to the first time limit), the down switch 28 is no longer actuated, the determination at step 208 will be negative. This will occur when a relatively brief actuation of the down switch 28 occurs. This brief actuation of the down switch 28 occurs when the occupant of the vehicle desires a relatively small downward movement of the window 14. Upon the negative determination at step 208, the process proceeds directly to step 224.

From the above description of the invention, those skilled in the art will perceive improvements, changes and modifications. For example, the switches 28, 30 may be solid-state devices and may be part of a multi-function control mechanism for the vehicle. Such improvements, changes and modifications within the skill of the art are intended to be covered by the appended claims.

Having described the invention, the following is claimed:

1. An apparatus for controlling a power window drive motor to move a window, said apparatus comprising:

switch means actuatable for providing a signal having a time duration;

means for selectively setting a first time limit;

means for determining whether the time duration of said signal from said switch means exceeds said first time limit;

means for operating the motor to move the window through a predetermined range of movement responsive to the time duration of said signal from said switch means exceeding said first time limit;

means for selectively setting a second time limit independent of said first time limit;

means for determining whether the time duration of operation of the motor exceeds said second time limit; and means for stopping the motor responsive to the time duration of operation of the motor exceeding said second time limit.

2. An apparatus as set forth in claim 1, wherein said means for selectively setting a first time limit includes a first RC circuit with a first resistor, said means for selectively setting a second time limit includes a second RC circuit with a second resistor.

3. An apparatus as set forth in claim 2, wherein said means for determining whether the time duration of said signal from said switch means exceeds said first time limit and said means for determining whether the time duration of operation of the motor exceeds said second time limit includes a timer means for counting timing pulses.

4. An apparatus as set forth in claim 3, wherein said first and second RC circuits are connected to said timer means, said first RC circuit providing timing pulses having a first clock frequency up to said first time limit, and said second RC circuit providing timing pulses having a second clock frequency used by said timer means from said first time limit up to said second time limit.

5. An apparatus as set forth in claim 4, wherein said timer means is incorporated into an integrated circuit, said first and second resistors are connected to said integrated circuit.

6. An apparatus for controlling a power window drive motor to move a window, said apparatus comprising:

switch means actuatable for providing a signal having a time duration;

means for selectively setting a first time limit;

means for determining whether the time duration of said signal from said switch means exceeds said first time limit;

means for operating the motor to move the window through a predetermined range of movement responsive to the time duration of said signal from said switch means exceeding said first time limit;

means for selectively setting a second time limit;

means for determining whether the time duration of operation of the motor exceeds said second time limit; and means for stopping the motor responsive to the time duration of operation of the motor exceeding said second time limit;

said means for selectively setting a first time limit including a first RC circuit having an exchangeable resistor and said means for selectively setting a second time limit including a second RC circuit having an exchangeable resistor.

7. An apparatus as set forth in claim 6, wherein said means for determining whether the time duration of said signal from said switch means exceeds said first time limit and said means for determining whether the time duration of operation of the motor exceeds said second time limit includes a timer means for counting timing pulses.

8. An apparatus as set forth in claim 7, wherein said first and second RC circuits are connected to said timer means, said first RC circuit providing timing pulses at a first clock frequency used by said timer means up to said first time limit, and said second RC circuit providing timing pulses at a second clock frequency used by said timer means from said first time limit up to said second time limit.

9. A method for controlling a power window drive motor to move a window, said method comprising:

selectively setting a first time limit;

selectively setting a second time limit independent of said first time limit;

actuating a switch means to provide a signal having a time duration;

determining whether the time duration of the signal from the switch means exceeds the first time limit;

operating the motor to move the window through a predetermined range of movement responsive to the time duration of the signal from the switch means exceeding the first time limit;

determining whether the time duration of operation of the motor exceeds the second time limit; and stopping the motor responsive to the time duration of operation of the motor exceeding the second time limit.

10. A method as set forth in claim 9, wherein said step of selectively setting a first time limit includes selecting a first resistor and placing the first resistor into a first RC circuit, said step of selectively setting a second time limit independent of said first time limit includes selecting a second resistor and placing the second resistor into a second RC circuit.

11. A method as set forth in claim 10, wherein said step of determining whether the time duration of the signal from the switch means exceeds the first time limit includes providing timing pulses at a first clock frequency from the first RC circuit and utilizing the first clock frequency to determine the first time limit, said step of determining whether the time duration of operation of the motor exceeds the second time limit includes providing timing pulses at a second clock frequency from the second RC circuit and utilizing the second clock frequency to determine the second time limit.

12. A method for controlling a power window drive motor to move a window, said method comprising:

selectively setting a first time limit;

selectively setting a second time limit;

actuating a switch means to provide a signal having a time duration;

determining whether the time duration of the signal from the switch means exceeds the first time limit;

operating the motor to move the window through a predetermined range of movement responsive to the time duration of the signal from the switch means exceeding the first time limit;

determining whether the time duration of operation of the motor exceeds the second time limit; and stopping the motor responsive to the time duration of operation of the motor exceeding the second time limit;

said step of selectively setting a first time limit including selecting a first exchangeable resistor and connecting the first exchangeable resistor into a first RC circuit and said step of selectively setting a second time limit including selecting a second exchangeable resistor and connecting the second exchangeable resistor into a second RC circuit.

* * * * *